United States Patent [19]

Roggendorff et al.

[11] 4,371,108

[45] Feb. 1, 1983

[54] METHODS OF MANUFACTURING LARGE TUBULAR COLUMNS

[76] Inventors: Stephen Roggendorff; Cuthbert J. Walker, both of 1 Cricketers Parade, Worthing, West Sussex, BN14 9DB, England

[21] Appl. No.: 188,751

[22] Filed: Sep. 19, 1980

[30] Foreign Application Priority Data

Aug. 9, 1980 [GB] United Kingdom ..... 8026041

[51] Int. Cl.[3] ..... B23K 31/02

[52] U.S. Cl. ..... 228/173 C; 29/430; 29/469

[58] Field of Search ..... 228/47, 173 C, 184; 29/429, 430, 469

[56] References Cited

U.S. PATENT DOCUMENTS

| | | | |
|---|---|---|---|
| 2,158,799 | 5/1939 | Larson | 228/184 X |
| 2,825,431 | 3/1958 | Molt | 228/173 C X |
| 3,694,911 | 10/1972 | Tomiyasu | 29/469 X |
| 3,921,555 | 11/1975 | Suzuki et al. | 29/469 X |
| 3,929,321 | 12/1975 | Sims | 228/173 C X |

*Primary Examiner*—Gil Weidenfeld
*Assistant Examiner*—Fred A. Silverberg
*Attorney, Agent, or Firm*—Eyre, Mann, Lucas & Just

[57] ABSTRACT

The invention relates to a method of manufacturing large tubular columns, for example, for use as the legs of off-shore well-drilling apparatus. Each column is manufactured by initially fitting stiffening ring segments to a plurality of shell segments and then welding the shell segments together to form a column section. After additional ring segments have been fitted across the joints between the shell segments, a series of tubular sections are welded together to form the column.

11 Claims, 18 Drawing Figures

71
54
28
115
52
53

93
62
64
101
94
95
103
66
102

36
37
61
63
65
46
104
105
106

68
61
67

65
104
46
105
106

69
70
68
62
67
64

68
61
63
67

METHODS OF MANUFACTURING LARGE TUBULAR COLUMNS

This invention relates to methods of manufacturing tubular members, and is particularly concerned with the manufacture of large tubular columns, for example, for use as constructional elements of marine structures such as off-shore well-drilling apparatus, or other submersible or semi-submersible structures. The invention is particularly concerned with the provision of tubular members which may be used as the legs of large marine structures.

In view of the considerable size and weight of many of the tubular members of the type with which the invention is concerned, it is normal practice to construct them from a number of parts which are assembled and welded together. Further, in view of the considerable forces which such columns have to withstand when they are in use, they must be produced very accurately and without any defects. In the past it has been normal procedure to use traditional constructional methods of the kind used in the ship-building industry, but it has been found that such methods suffer from disadvantages when adapted to the construction of large tubular columns.

Accordingly, it is an object of the present invention to provide a method of manufacturing tubular members which does not suffer from these disadvantages.

The invention consists in a method of manufacturing tubular members in which plate material is formed into a plurality of shell segments, in which a plurality of stiffening ring segments are secured to each shell segment, in which a plurality of stiffened shell segments are assembled into a tubular section, and in which a plurality of said tubular sections are assembled co-axially end-to-end to form a longitudinally extending tubular member.

The invention is primarily concerned with the manufacture of members in which both the plate material and the stiffening ring segments consist of steel and welding is preferably used to secure the ring segments to the shell segments, to secure the shell segments to one another to form the tubular sections, and also to join the tubular sections end-to-end.

Essentially the tubular members are of circular cross-section and each shell segment may, for example, be in the form of a 120° arc so that three such segments constitute the complete circle. Preferably the ring segments are secured to the concave surface of the shell segments and have a somewhat smaller angular extent than the shell segments so that a space is left at each end of each shell segment which is free from ring segments. This space enables the abutting edges of two shell segments to be welded internally as well as externally. Once the internal weld has been completed, further ring segments are inserted between the ends of the existing segments to complete the circle of stiffening rings.

Preferably the plate material is rolled to form it into the required shell segments and each segment is transported to a positioner having clamping means mounted on a circular plate which is rotatable about a horizontal axis in a tower body which is itself rotatable about a vertical axis. After the shell segment has been secured by the clamping means, the tower body is rotated through 90° so that the stiffening ring segments can be placed in position and welded by means of an assembling and welding machine of the type which includes upper and lower jaws. These jaws support clamping means and also welding means.

After the stiffening ring segments have been welded in position, the tower is rotated through a further 90° so that the stiffened shell segment can be transported by means of a transfer trolley to a second positioner generally similar to that already described. This positioner receives a first shell segment and supports it by means of clamping means which engage the flanges of the stiffening ring segments. After the first shell segment has been clamped in position, the plate of the positioner is rotated through 120° about its horizontal axis and a second shell segment is picked up by the next set of clamping means. Similarly, the third shell segment is picked up after further rotation of the plate through 120°. Thereafter, the positioner is rotated through 90° about its vertical axis to present three stiffened shell segments to a further assembling and welding machine which accurately clamps the edge portions of the shell segments in succession so that the abutting edges can be accurately lined up and tack-welded. After the tack-welding, the same assembling and welding machine is used to perform an internal weld on each seam.

The second positioner is then rotated through a further 90° to return the tubular section to the production line for the seams to be externally welded. The completed tubular sections are then moved to a further station in which the abutting circular edges of two adjacent tubular sections are welded together by means of a further assembling and welding machine similar to those already described. It is to be understood that the assembling and welding machine is provided not only with means for aligning the abutting edges of the two sections, but also with means for drawing the two sections together so that the abutting edges are in contact.

In the next stage, the circumferential joints between adjacent tubular sections are externally welded.

In a final stage, longitudinal stiffening elements are inserted in recesses provided in the stiffening rings.

The specific nature of the invention as well as other objects, advantages and features thereof, will become readily apparent from the following detailed description of preferred embodiments taken in conjunction with the accompanying drawings.

Figure 1A:
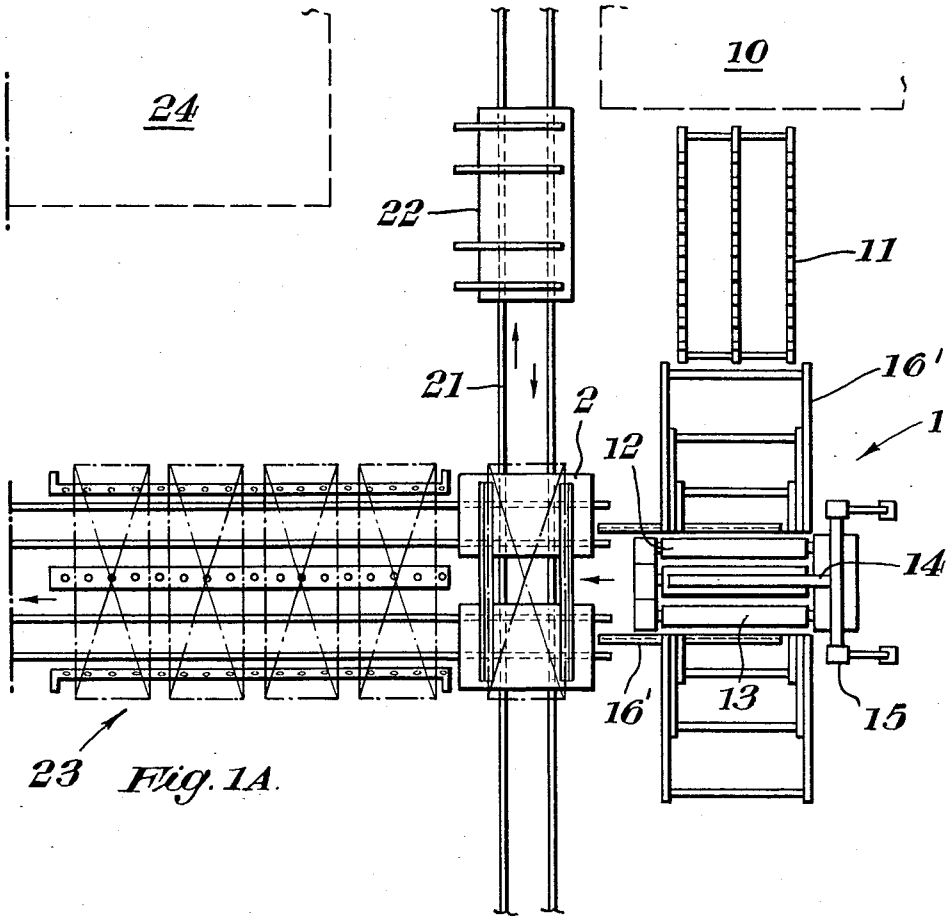
FIGS. 1A to 1E represent successive parts of a method in accordance with the invention.

The embodiments of the invention to be described are concerned with the production of tubular columns of circular cross-section from a number of tubular sections, each of which itself is produced from three shell segments. Thus the first step in the method of manufacture to be described consists in rolling a plurality of flat metal plates into shell segments, each of which spans an arc of 120°. This step is carried out on apparatus as illustrated in FIG. 1A. This apparatus includes a preparation area 10 in which the flat metal plates are prepared. They are transferred from this area to a loading table 11 from which they pass to a hydraulic plate-bending machine generally indicated at 1. This plate-bending machine includes lower plate rollers 12 and 13 and an upper plate roller 14. The support for the upper plate roller includes an overhead bridge 15. The machine also includes lateral supports 16.

When the plates have been bent to the required shape, they are moved along a roller discharge 16' to a transfer trolley 2. This transfer trolley is movable on rollers 21 so that shell segments can be transferred to second and third assembly lines if desired. A transfer bridge for the shell segments is indicated at 22.

Shell segments required for the assembly line illustrated are moved from the transfer trolley to a buffer station 23 which is provided with castors for linear movement. The reference numeral 24 indicates a preparation area for steel stiffening ring segments 28.

Figure 1B:
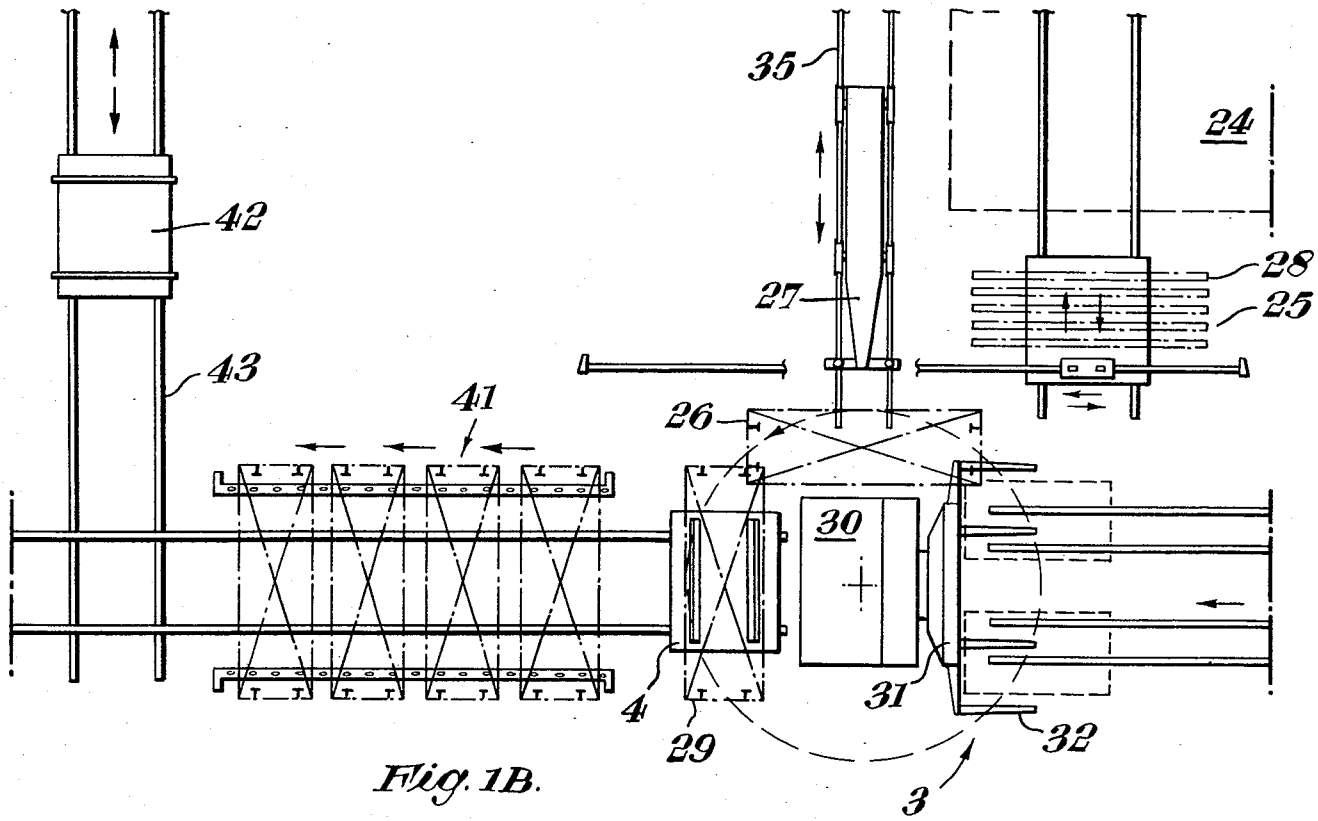
Figure 2:
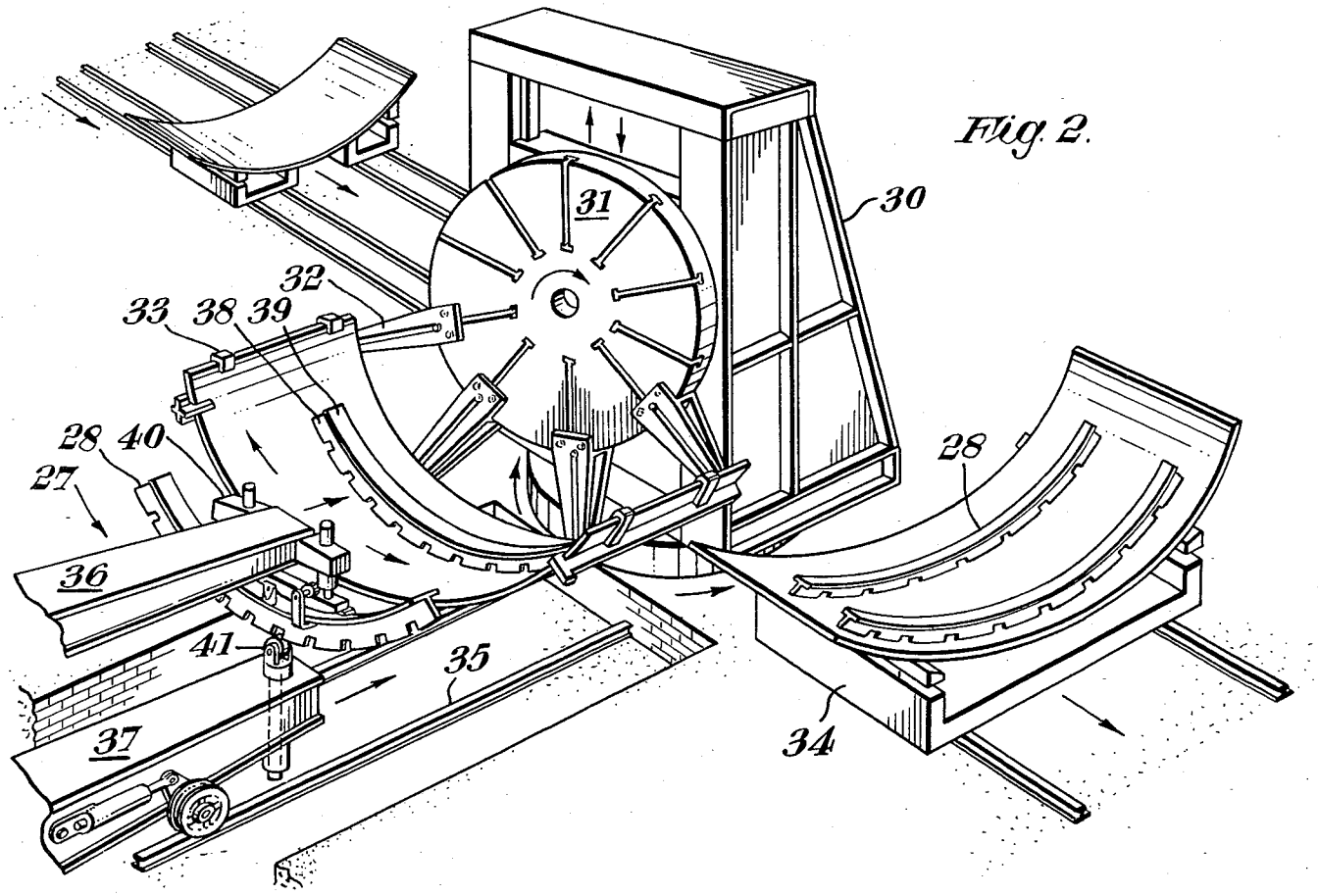
FIG. 2 is a perspective view of some of the equipment used in the part of the production line illustrated in FIG. 1B.

The leading segment in the buffer station 23 is presented to a positioner 3 which is illustrated in FIG. 1B. In addition, steel stiffening ring segments 28, each of which spans an arc of about 90°, are stored on a loader 25. The positioner 3 is illustrated in more detail in FIG. 2, and it will be seen that it includes a main body 30 which is rotatable about a vertical axis. The rotatable main body carries a plate 31 which is rotatable about a horizontal axis. The plate 31 carries four radially-adjustable arms 32 which themselves carry clamping means 33. As can be seen from FIG. 2, these clamping means are capable of clamping one of the 120° shell segments on the front and rear arcuate edges as well as on the longitudinal side edges.

The shell segment at the head of the queue is presented to the positioner on transfer trolley 34, and is gripped by the clamping means 33. The positioner is then rotated about its vertical axis through 90° to the position shown in FIG. 2 and indicated in FIG. 1B in broken lines at 26. With the positioner in this position, the shell segment is located to receive a pair of stiffening ring segments from an assembling and welding machine 27. This machine travels on rails 35 which are perpendicular to the extent of the production line. The machine includes upper and lower jaws 36 and 37. Each of the stiffening ring segments 28 includes a web 38 and a flange 39 and the upper jaw 36 is provided with clamping means 40 capable of gripping the flange 39 of a ring segment. The machine is moved on the rails 35 until the ring segment held by the clamping means 40 is correctly positioned longitudinally with respect to the shell segment held by the clamping means 33. The jaw 36 is then lowered until the ring segment is in contact with the shell segment. A roller jack 41 is then raised in contact with the lower side of the shell segment. When the first ring segment is accurately positioned relative to the shell segment, it is tack-welded in position. Thereafter, an automatic continuous welder (not shown) carried on the end of the jaw 36 is swung into the position in front of the clamping means 40 and the clamping means are released so that the assembling and welding machine 27 can be retracted to the required extent to bring the welder into position to weld the flange 38 of the ring segment to the shell segment. For this operation, the plate 31 is initially rotated about its horizontal axis until the welder is located adjacent to one end of the ring segment, and is thereafter rotated at welding speed so that a continuous weld can be produced.

After the first ring segment has been welded into position, a second ring segment is placed in position by the assembling and welding machine, and the process described above is repeated. Thereafter the assembling and welding machine is retracted, and the positioner 30 is rotated through a further 90° to the position indicated in FIG. 1B by broken lines 29. The shell segment, together with its two stiffening ring segments is then deposited on a transfer trolley 4 and moved into a buffer station 41. If desired, assembled shell and ring segments can be moved to and from a second assembly line or a quality control area by means of a transfer bridge 42 and rails 43.

Figure 1C:
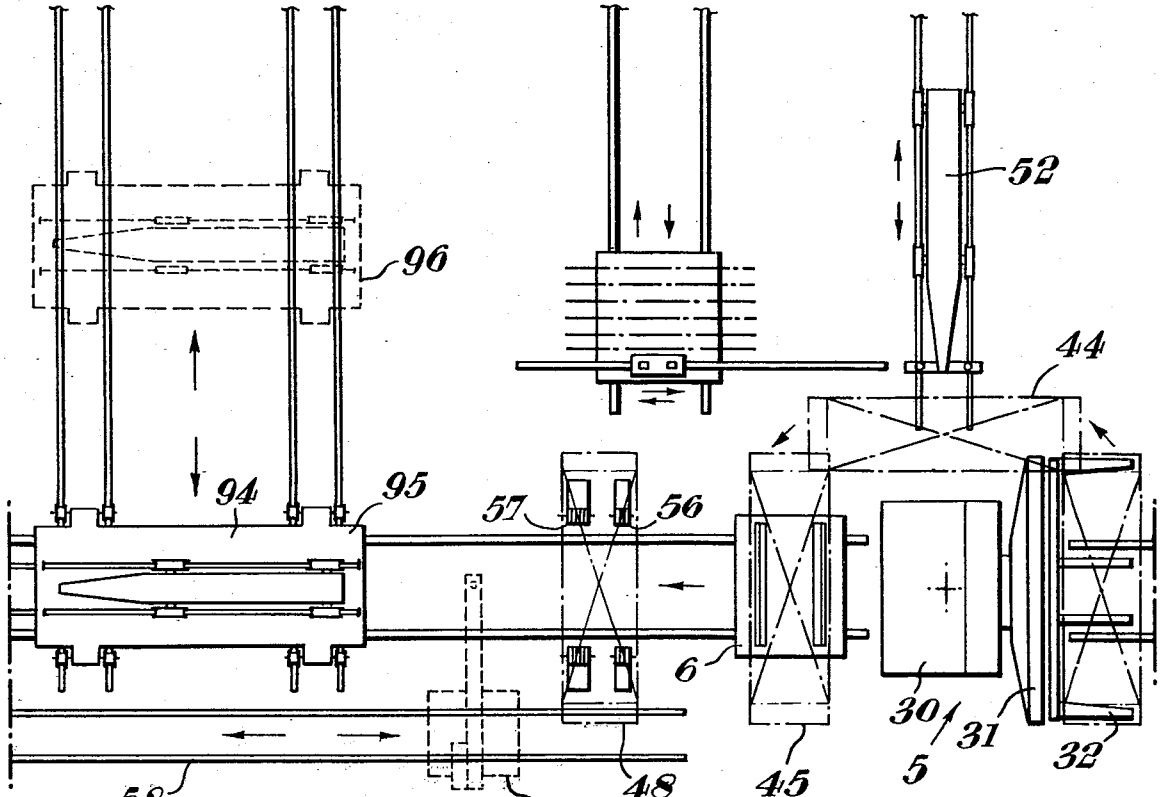
Figure 3:
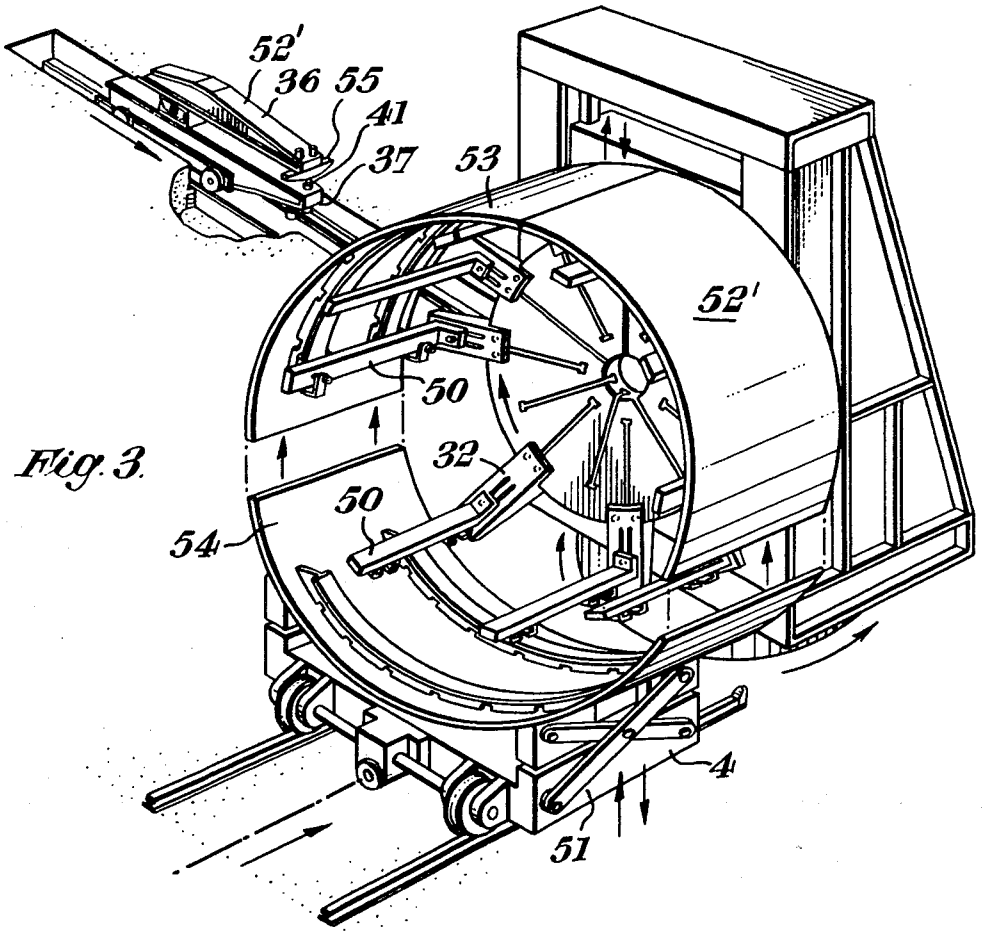
FIG. 3 is a perspective view of a part of the equipment used in the part of the production line illustrated in FIG. 1C.

The leading shell segment in the queue for the assembly line illustrated is moved up to a second positioner 5 shown in FIG. 1C and generally similar to the positioner 3. The positioner 5 is illustrated more particularly in FIG. 3, and it will be seen that it is provided with nine radial arms 32 which have a different form of clamping means from that shown in FIG. 2. In this case, the clamping means 50 are designed to grip the flanges 39 of the stiffening ring segments. The transfer trolley 4 is provided with jack means, generally indicated at 51, for raising and lowering the shell segment which it is carrying. Thus, after the trolley has been moved into position below three of the clamping means 50, it can be raised so that the segment can be held by these clamping means. After one segment 52 has been picked up by the positioner, the plate 31 is rotated through 120°, and a second segment 53 is moved into position by the respective trolley. It is then picked up by the next three radial arms, and the plate 31 is rotated through a further 120°. The third segment 54 is then moved into position as shown in FIG. 3. It can be seen that the first segment 52 has been rotated through 240°, and the second segment 53 has been rotated through 120°. The third segment 54 is then raised on its trolley so that it can be gripped by the three clamping means 50 which are now in the lowermost position. When the three segments have been picked up by the respective clamping means, the positioner 5 is rotated through a further 90° about its vertical axis into the position indicated in broken lines in FIG. 1C at 44. In this position, a second assembling and welding machine 52' is located ready for carrying out the next steps in the production process.

Figure 4B:
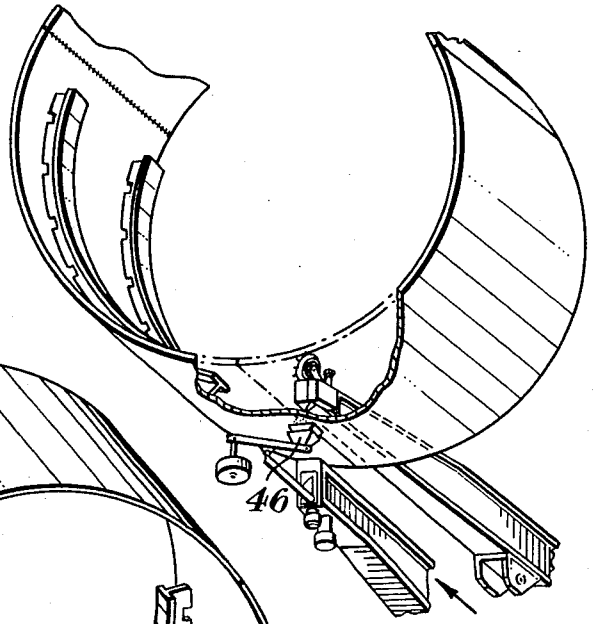
FIGS. 4A to 4C illustrate three of the operations carried out in the part of the production line illustrated in FIG. 1C.
Figure 4C:
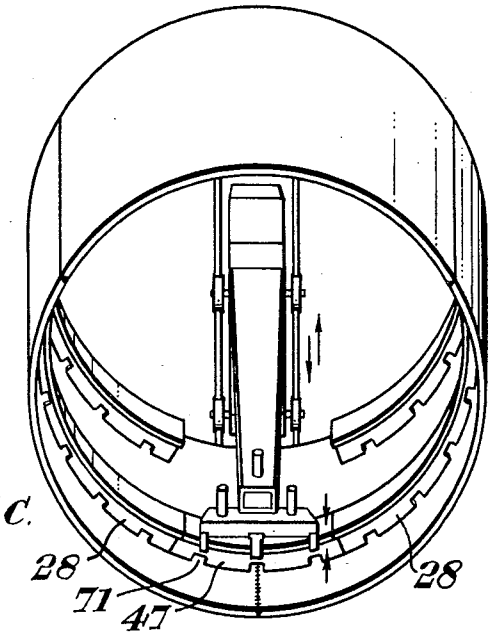
Figure 4A:
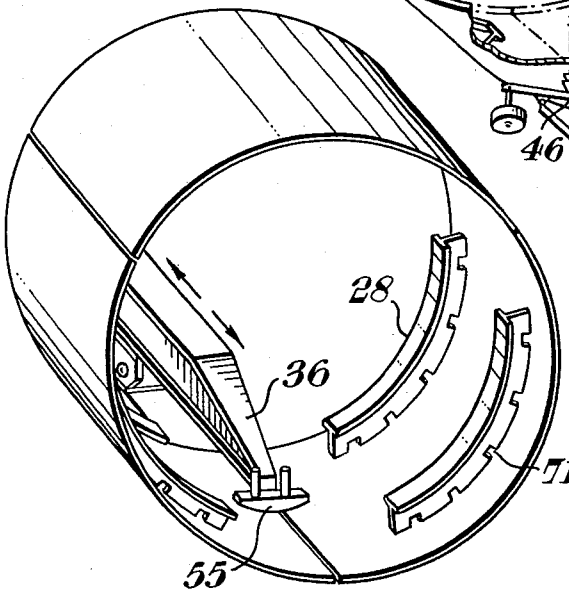

The plate 31 of the positioner 5 is now rotated so that the abutting edges of two of the shell segments are located vertically below the axis of rotation of the plate. It is to be understood that, while the positioner is in the position shown in FIG. 3, the clamping means 50 are used to ensure that the arcuate edges of the shell segments are located in parallel planes, and also to ensure that the abutting edges of the segments are as close together as possible. However, final alignment of the abutting edges is carried out by means of the assembling and welding machine 52'. For this purpose, the jack 41 on the lower jaw 37 of the assembling and welding machine is located below the lowermost pair of abutting edges, and the arcuate member 55 on the upper jaw 36 is located above these two edges. The clamping action of the two jaws is then used to produce perfect alignment of the two abutting edges as shown in FIG. 4A, and the seam is tack-welded. When the joint is secure, the clamp is released and the continuous welding apparatus shown diagrammatically in FIG. 4B is swung into position. The internal weld of the seam is then completed.

It is, of course, to be understood that, during this welding process, the tack welds will be remelted. It can also be seen from FIG. 4B that a motorized flux backing system 46 is mounted on the lower jaw 37 and travels along the back of the seam as it is being welded.

After the first seam has been welded, the plate 31 is rotated through 120°, and the second welding operation is carried out. Thereafter the plate is again rotated through 120°, and the third seam is completed.

When the three welds have been completed, the assembling and welding machine 52' is used to place further stiffening ring make-up segments 47 in position between the ends of the ring segments 28 which have already been welded to the shell segments. This part of the operation is illustrated in FIG. 4C. After each additional ring segment 47 has been placed in position by the assembling and welding machine 52', it is tack-welded and then, after the segments 47 have been released, the weld is completed by the assembling and welding machine in the same way as described with reference to FIG. 2. To assist in insertion of the additional stiffening ring segments 47 into position, it is preferred that the ends of all the stiffening ring segments 47 and 28 should be cut on a radius of the completed tube.

The positioner 5 is now rotated through a further 90° so that the tubular section made up from the three shell segments 52, 53 and 54 is in the position shown in broken lines in FIG. 1C at 45. The tubular section is lowered by the positioner on to a further transfer trolley 6, and is then moved into the position indicated at 48 where it is carried on idler rollers 56 and driven rollers 57. An external welding boom 73 is then moved into position on rails 58, and the tubular section is rotated until one of the seams is uppermost. The external welding boom is then used to weld the outside of this uppermost seam. The tubular section is then rotated through 120° twice to enable the two other seams to be externally welded.

Figure 1D:
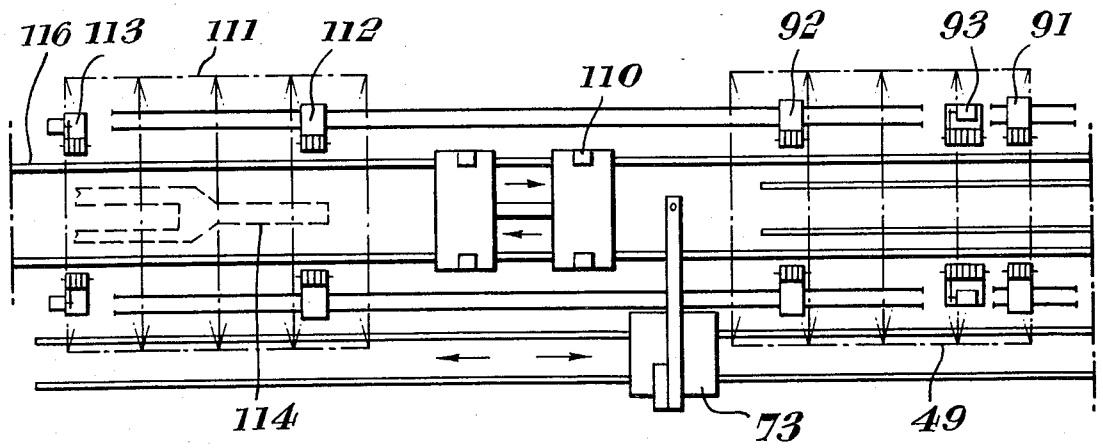

The completed section is now moved into the position indicated at 49 in FIG. 1D. In this position, the completed sections are supported on idler rollers 91 and 92 and driven rollers 93. When two sections have been assembled, a third assembling and welding machine 94 (FIG. 1C) is moved on a transfer bridge 95 from the side position shown in broken lines at 96 to the position shown in full lines in FIG. 1C. In this position, the assembling and welding machine 94 is used to join together the two assembled sections by means of an internal circumferential weld. This operation is shown in more detail in FIGS. 5A to 5F.

Figures 5A, 5B, 6:
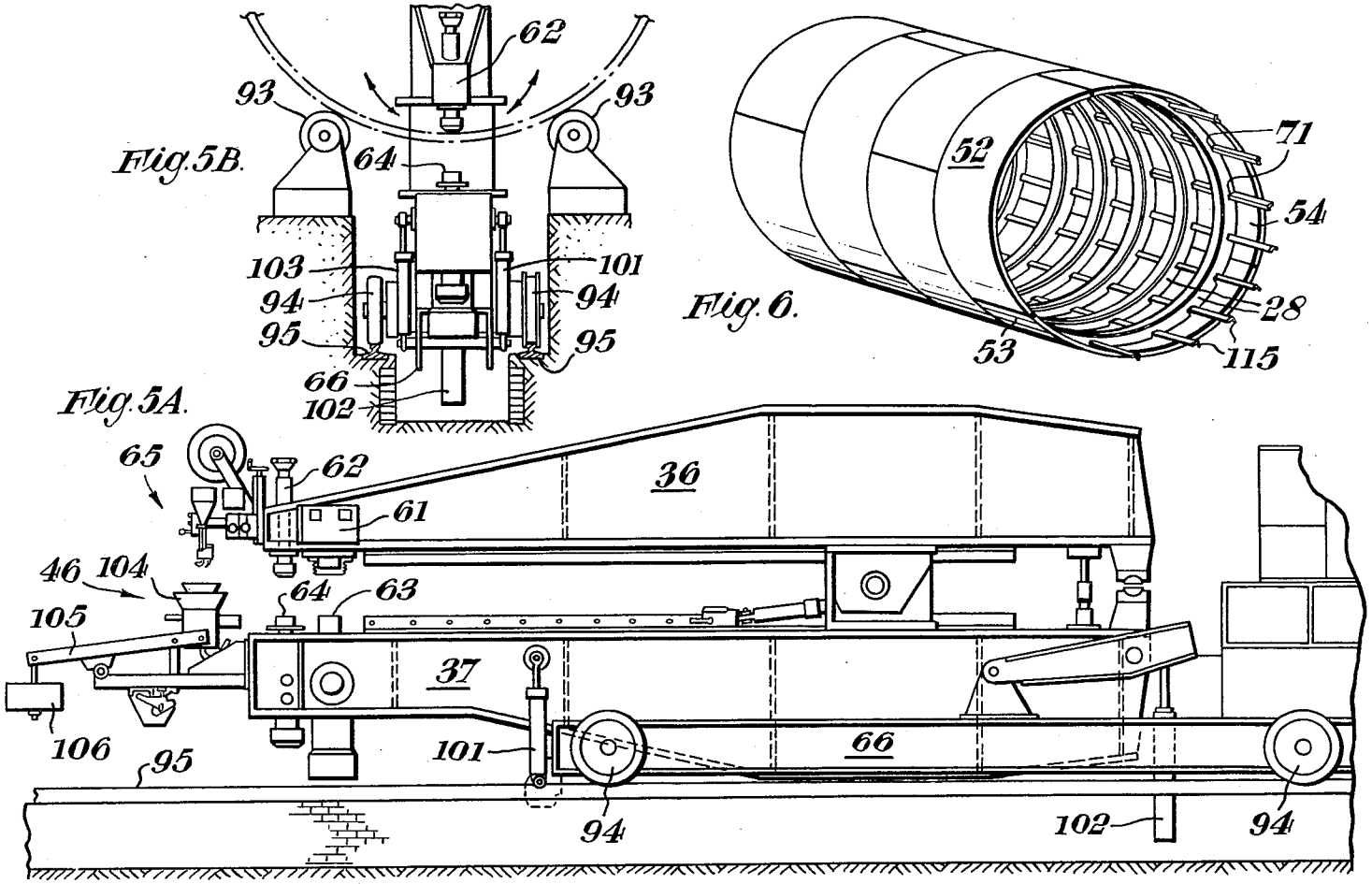
FIG. 5A is a side view of an assembling and welding machine used in a number of stages of the production line.
FIG. 5B is an end view of the machine illustrated in FIG. 5A.
FIG. 6 is a perspective view of a completed tubular member produced by a method in accordance with the invention.

FIGS. 5A and 5B show the assembling and welding machine 94 in more detail, and it can be seen that this machine includes the upper jaw 36 and the lower jaw 37 previously referred to. Mounted on the upper arm are two hydraulic presses 61 and 62. These cooperate respectively with sub-presses 63 and 64 on the lower jaw 37. This illustration also shows the seam welder 65 and the motorised flux backing system 46. The lower jaw 37 is mounted on a chassis 66 by means of three hydraulic jacks 101, 102 and 103, which enable the height and attitude of the jaws to be adjusted as required. The chassis 66 is supported on wheels 94 which run on rails 95.

Figures 5C, 5D, 5E, 5F:
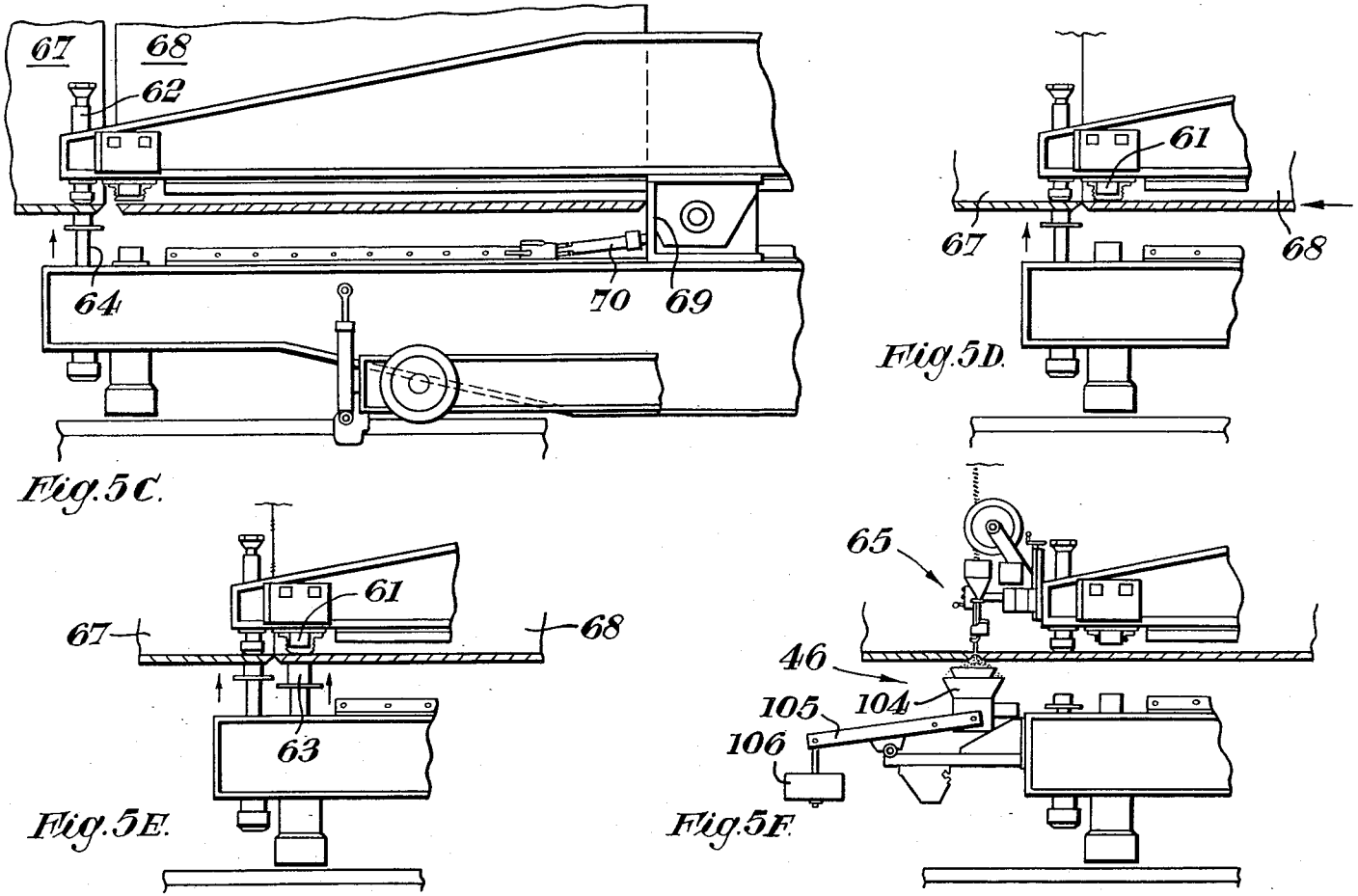
FIGS. 5C to 5F illustrate various uses of the machine illustrated in FIGS. 5A and 5B.

FIG. 5C shows the trailing edge of a first tubular section 67 clamped between the press 62 and the sub-press 64. This Figure also shows a second tubular section 68 which is to be joined to the section 67. It will be seen that the rear end of the section 68 abuts up against a pressure plate 69 controlled by a hydraulic cylinder 70. The pressure plate 69 is advanced under the control of the hydraulic cylinder 70 until the edges of the two tubular sections 67 and 68 are brought into contact as shown in FIG. 5D. The press 61 and sub-press 63 are then closed to clamp the section 68 as shown in FIG. 5E. While the two sections are clamped in this manner, they are tack-welded on either side of the clamping presses. The presses and sub-presses are then released and the two tubular sections are rotated about their axes by means of the driven rollers 93. The clamping presses are then closed again and further tack-welds are made. This process is repeated until the full circumference is tack-welded. Thereafter the two presses 61 and 62 and the two sub-presses 63 and 64 are released and the assembling and welding machine is retracted so that the welder 65 is located adjacent to the abutting edges as shown in FIG. 5F. The two tubular sections 67 and 68 are then rotated at welding speed and the internal circumferential weld is completed. During this process the underside of the weld is protected by the motorised flux backing system 46. It will be seen that the flux container 104 is mounted on a lever arm 105 and is supported against the underside of the weld by a weight 106. A motor-driven screw feeds a continuous supply of flux to the back of the weld and an automatic suction recovery system returns flux to the container to minimise wastage.

The external welding boom 73 is then moved on the rails 58 until it is in position to complete an external weld of the seam between the two tubular sections.

The two sections are then moved forwardly on the turning rolls assisted by the transport carriage 110 and the assembling and welding machine 94 is moved back into the side position as shown at 96 (FIG. 1C) to enable a third tubular section to be moved up on the transfer trolley to the position indicated at 49. The second circumferential seam is now welded internally and externally in the manner already described, and the three sections are moved forwardly to enable a fourth section to be accommodated in position 49.

It is to be understood that the number of sections joined together at this stage may be varied in accordance with requirements. However, in one particular embodiment, four sections each having an axial length of ten feet and a diameter of thirty-five feet are welded together to form a forty foot tubular member.

When the required number of sections have been joined together, the complete assembly is loaded off the rollers 91, 92 and 93 and onto a transport carriage 110, by means of which is is moved to the position indicated at 111. In this position the assembly is supported on turning rollers 112 and 113.

It will be seen that the webs 38 of the stiffening ring segments are provided with recesses 71. It is to be understood that these recesses are all longitudinally aligned along the length of the tubular member and, when the required number of tubular sections have been assembled, longitudinal stiffeners 115 are inserted in these recesses and welded into position by means of a feeding and welding machine 114. This machine is shown in full lines in FIG. 1E and in broken lines in FIG. 1D, and the completed tubular member with the longitudinal stiffeners 115 in position is shown in FIG. 6.

Figure 1E:
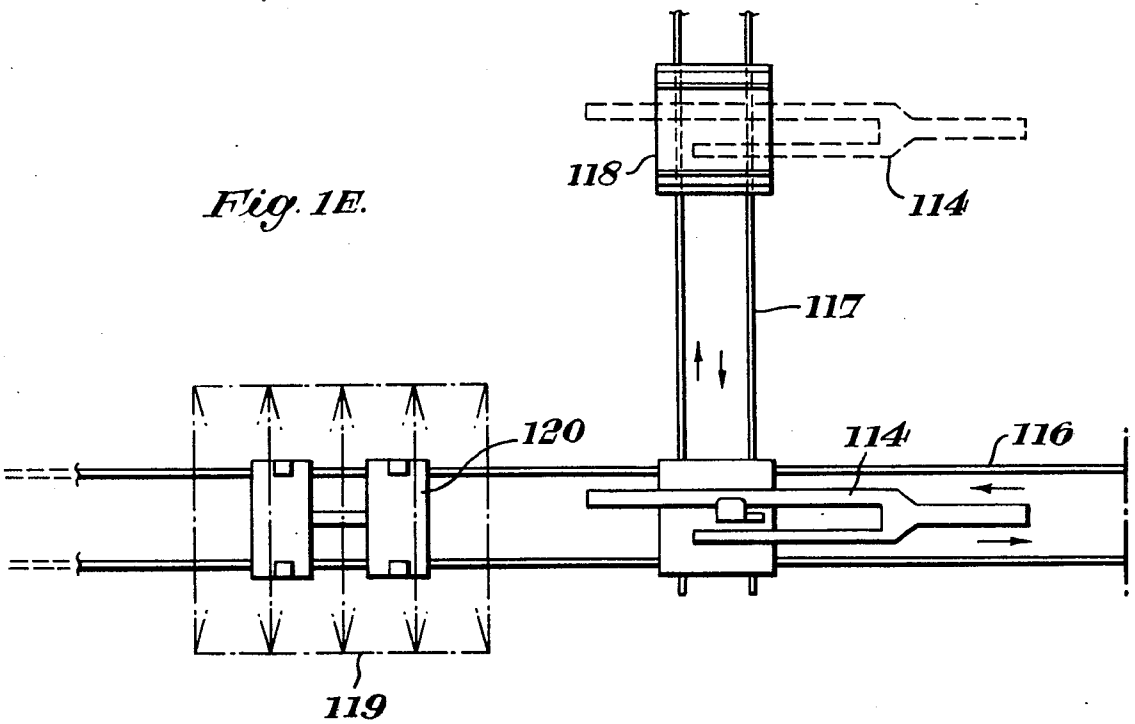

It will be seen that the feeding and welding machine 114 is movable from the position shown in FIG. 1E to the position shown in FIG. 1D on rails 116. It is also movable to a position at the side of the production line on rails 117 by means of a transfer bridge 118. When all the longitudinal stiffeners have been inserted and welded in position as shown in FIG. 6, the feeding and welding machine 114 is moved into the side position and the completed tubular member is moved to the position indicated at 119 on a transport carriage 120 which also runs on the rails 116.

Figure 7:
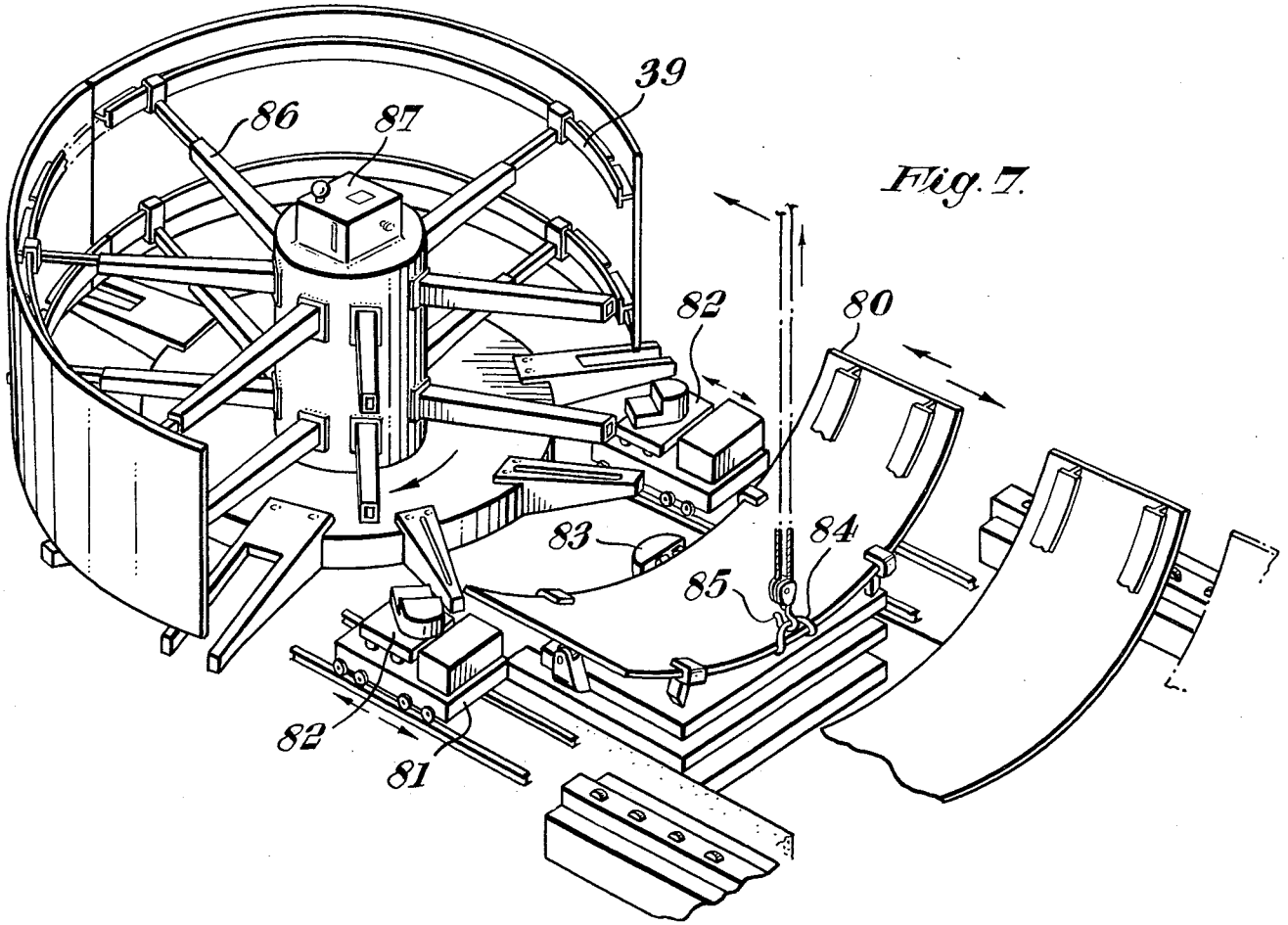
FIG. 7 is a perspective view of alternative equipment for use in place of the equipment illustrated in FIG. 3.

In the case of very large diameter tubular members, it may be difficult to assemble the three segments about a horizontal axis as described with reference to FIG. 3. In this case, the shell segments with their stiffening ring segments welded in position are assembled about a vertical axis by means of apparatus as shown in FIG. 7. It will be seen that, in this case, the shell segments 8 are moved on trolleys similar to those described with reference to FIG. 3, but that, when the segments reach the assembling jig, they are tilted through 90° by means of a shop crane so that they can be assembled about a vertical axis. It will also be seen that they are tilted on to trolleys 81 which are movable longitudinally with respect to the production line and include platforms 82 which are adjustable vertically. These platforms carry rollers against which the concave surface of the segment 80 abuts when it has been tilted. It will also be seen that, during the tilting process, the forward edge of the segment 80 is held by clamping means 83 which is mounted on an arm capable of pivotting about a horizontal axis perpendicular to the longitudinal direction of the production line. Also mounted on the pivotting arm is a further clamp 84 which engages the rear arcuate edge of the shell segment. The clamping means 84 is provided with ring means to receive the hook 85 of the shop crane.

Each of the three 120° shell segments is tilted into position, and then engaged by radial arms 86 mounted on a hub 87 which is rotatable about a vertical axis. The arms 86 include adjustable clamping members capable of engaging the flanges 39 of the stiffening ring segments. The arms 86 are capable of moving independently to locate the shell segments accurately with respect to each other. When they have been accurately located, the seams are welded internally by means not shown.

What we claim is:

1. A method of manufacturing tubular members in which metal plate is rolled into a plurality of shell segments of arcuate cross-section, in which each of said rolled shell segments is transported to a first positioner having clamping means mounted on a circular plate which is rotatable about a horizontal axis in a tower body which is itself rotatable about a vertical axis, in which a plurality of metal stiffening ring segments of arcuate cross-section are welded to the concave surface of each of said rolled shell segments to form stiffened shell segments, the angular extent of each of the ring segments being less than that of each of the the shell segments so that a space is left at each end of each of the rolled shell segments which is free from ring segments, in which a plurality of stiffened shell segments are assembled and welded together to form a tubular section, and in which a plurality of said tubular sections are assembled coaxially end-to-end and welded together to form a longitudinally extending tubular member.

2. A method as claimed in claim 1, wherein after each of said rolled shell segments has been clamped in position in said clamping means, the tower body is rotated about its vertical axis so that the stiffening ring segments can be placed in position and welded to each of the rolled shell segments by means of an assembling and welding machine which includes upper and lower jaws supporting clamping means and welding means.

3. A method as claimed in claim 2, in which, after the stiffening ring segments have been welded in position, the tower is again rotated about its vertical axis so that the stiffened shell segments can be transported to a second positioner having clamping means mounted on a circular plate which is rotatable about a horizontal axis in a tower body which is itself rotatable about a vertical axis.

4. A method as claimed in claim 3, in which each of the stiffening ring segments comprises a flange and a web, in which the web of each of said stiffening ring segments is welded to a respective shell segment, and in which the clamping means of said second positioner are adapted to engage the flanges of the stiffening ring segments.

5. A method as claimed in claim 4, in which, after each of the rolled shell segments has been clamped in position, the circular plate of the second positioner is rotated about its horizontal axis, and another rolled shell segment is picked up by a further set of clamping means, whereafter the circular plate is again rotated about its horizontal axis to enable still another rolled shell segment to be picked up.

6. A method as claimed in claim 8, in which, after the number of shell segments required to complete the tubular section have been picked up by the second positioner, the second positioner is rotated about its vertical axis to present the stiffened shell segments to a further assembling and welding machine which accurately clamps the edge portions of the shell segments in succession so that the abutting edges can be lined up to form seams therebetween and tack-welded.

7. A method as claimed in claim 6, wherein, after the tack-welding of each of the seams the clamping means of the further assembling and welding machine are released and the said further assembling and welding machine is used to perform an internal weld on the seams.

8. A method as claimed in claim 7, wherein, when the joints between the abutting edges of the shell segments forming the tubular section have been completed, further ring segments are inserted between the ends of the previously fitted ring segments to complete each circle of stiffening ring segments.

9. A method as claimed in claim 8, in which, after the further ring segments have been welded in position, the second positioner is rotated about its vertical axis to enable the seams between the abutting edges of the shell segments to be externally welded.

10. A method as claimed in claim 9, wherein the completed tubular sections are moved to a station in which the abutting circular edges of two adjacent tubular sections are welded together by means of a further assembling and welding machine provided not only with means for aligning the abutting edges of the two sections, but also with means for drawing the two sections together so that the abutting edges are in contact.

11. A method as claimed in claim 8, wherein the angular extent of each of the shell segments is 120°, the angular extent of each of the stiffening ring segments is 90°, and the angular extent of each of the further ring segments is 30°.

* * * * *